United States Patent [19]

Channing et al.

[11] 4,017,082

[45] Apr. 12, 1977

[54] MEANS AND METHOD FOR PLACING A GOLF BALL POSITION MARKER ON A PUTTING GREEN AND FOR REMOVAL THEREOF

[75] Inventors: Charles E. Channing, Dover; George H. Darrell, Dedham, both of Mass.

[73] Assignee: Charles E. Channing, Dover, Mass.

[22] Filed: Apr. 29, 1975

[21] Appl. No.: 572,879

[52] U.S. Cl. ..... 273/162 D; 294/65.5

[51] Int. Cl.[2] ..... A63B 57/00

[58] Field of Search ..... 273/32 R, 32 A, 32 D, 273/162 R, 162 C, 162 D, 1 M, 95 R, 106 B; 294/65.5

[56] References Cited

UNITED STATES PATENTS

| | | | |
|---|---|---|---|
| 1,634,652 | 7/1927 | Czichos | 273/162 C |
| 2,178,872 | 11/1939 | Engstrom | 273/162 D |
| 2,385,859 | 10/1945 | Jacobson | 294/65.5 X |
| 2,722,062 | 11/1955 | Phillips | 273/162 C X |
| 2,732,243 | 1/1956 | Mount | 294/65.5 |
| 2,767,517 | 10/1956 | Hooper | 294/65.5 X |
| 2,979,335 | 4/1961 | Pruitt | 273/162 D |
| 2,993,723 | 7/1961 | Twachtman et al. | 294/65.5 |
| 3,228,720 | 1/1966 | Jordan | 294/65.5 |
| 3,275,320 | 9/1966 | Hydock | 294/65.5 X |
| 3,425,468 | 2/1969 | Soucy | 294/65.5 X |
| 3,844,565 | 10/1974 | Gigliotti | 273/162 E X |
| 3,895,797 | 7/1975 | Moore | 273/32 A |

FOREIGN PATENTS OR APPLICATIONS

| | | | |
|---|---|---|---|
| 912,515 | 12/1962 | United Kingdom | 273/162 D |
| 1,142,948 | 2/1969 | United Kingdom | 273/162 D |

*Primary Examiner*—Richard J. Apley
*Attorney, Agent, or Firm*—Richard P. Crowley

[57] ABSTRACT

An elongated rod, such as a golf putter, has a permanent magnet secured at one end. A golf ball position marker of magnetic material is releasably held on the end of the putter by the magnetic attraction between the magnet and the material of the marker. The marker is placed in position by maually lowering the end of the putter carrying the marker onto the surface of the putting green exerting pressure on the putter to press the marker into place. The putter is then moved parallel to the surface of the green to slide it off of the marker, the marker being retained in position by a projection on the lower side engaging the surface of the green. The marker is removed by bringing the magnet back into contact with the marker and then lifting it vertically to pull the marker away from the surface of the green.

19 Claims, 11 Drawing Figures

MEANS AND METHOD FOR PLACING A GOLF BALL POSITION MARKER ON A PUTTING GREEN AND FOR REMOVAL THEREOF

BACKGROUND OF THE INVENTION

In the game of golf, when a player's ball on a putting green is in a position in which it might be considered as obstructing the play of another player awaiting his turn to putt, the first player is required to lift his ball from the surface of the putting green, to be replaced in its original position when the first player is again ready to putt. It is usual for such a player to place a small marking device in such position on the putting green so that his ball may be returned to its original location when the marker is removed and play resumed. For many players the effort involved in bending down to position the marker by hand and later to retrive the marker, constitutes an inconvenient and fatiguing procedure.

SUMMARY OF THE INVENTION

The present invention provides a simple and inexpensive means and method whereby the necessity for the player to bend down to place and remove the marker is eliminated with a consequent elimination of the inconvenience and fatigue involved. This is accomplished by attaching to the end of an elongated rod, such as a golf putter, a small permanent magnet and by using a marker consisting, at least in part, of ferrous material so that it will adhere to the end of a putter or rod when placed in contact with the magnet. The relationship between the putter and the marker is such that the marker may be readily placed in the proper position on the surface of the putting green and, by a simple sliding motion of the putter, the player may detach the marker, leaving it in position on the green. After the ball has been removed by tapping it out of position, it may be made to adhere to the putter by bringing the magnet into contact with the marker, whereupon the marker may readily be lifted and retrieved by the player.

DETAILED DESCRIPTION OF THE INVENTION

Figure 1:
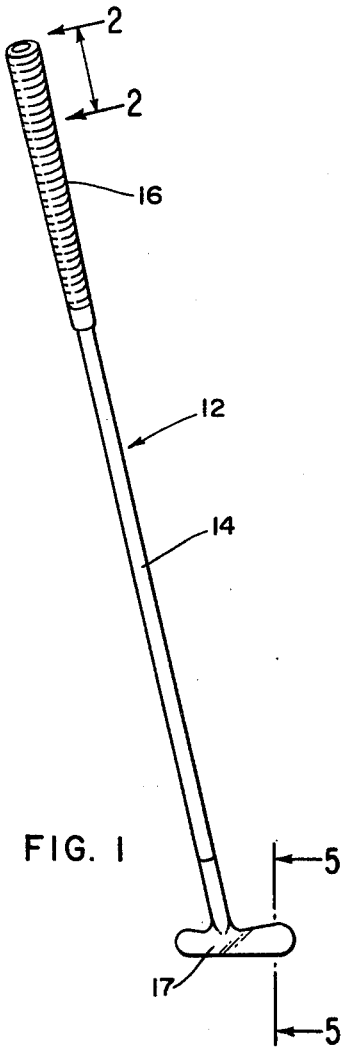
FIG. 1 is a side view of a putter club in which a ball marker holding magnet may be incorporated.
Figure 4:
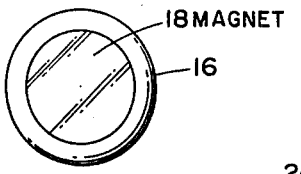
FIG. 4 is a top view of the club shown in FIG. 2, having a magnet mounted therein.
Figure 2:
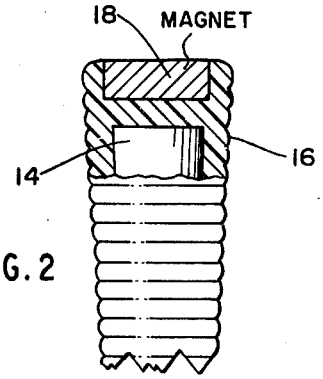
FIG. 2 is an enlargement, partly in section, of the upper end of the club as indicated by the arrows 2—2 in FIG. 1.

In FIG. 1, 12 is a putter club comprising a shaft 14, a handle 16 and a putter head 17. As shown in FIG. 2, the handle 16, consisting of a tough resilient sleeve of non-magnetic material is secured over the end of shaft 14. A permanent magnet 18, preferably in the form of a flat disk, is secured in a pocket formed in the end of handle 16 so that the outer surface of the magnet 18, which comprises one of the magnetic poles of the magnet, is substantially flush with the end surface of the handle 16.

Figure 3:
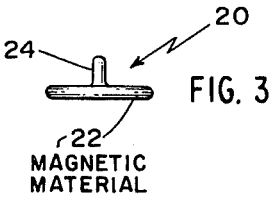
FIG. 3 is a side view of a ball marker.

The ball position marker 20, shown in FIG. 3, is made wholly or partially of magnetic material. Such material is perferably of an inexpensive low magnetic retentivity material such as soft iron. Marker 13 consists of a small disk 22 having a projection 24 extending from one side.

Figure 8:
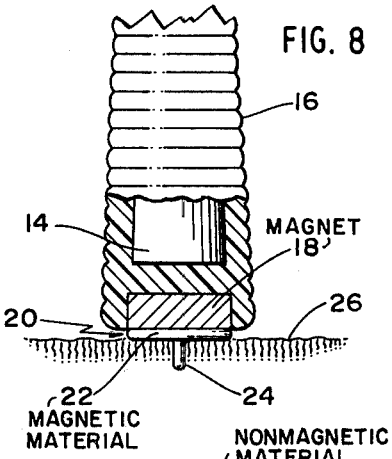
FIG. 8 shows the upper end of the club illustrated in FIG. 2, with the marker held in place by the magnet as it is inserted into the surface of the putting green.

In order to use the combination of club and marker, the flat outer surface of the disk 22 is brought manually into contact with the flat outer surface of magnet 18 where it is retained in place by the magnetic field of the magnet. The club is then inverted and the end of its handle 16 is lowered to the ground, as shown in FIG. 8 and the marker 20 is pressed against the surface 26 of the putting green, forcing the projection 24 into such surface with the disk 22 resting on top of such surface. Thereupon the club is moved sideways so that the magnet 18 slides off of the marker 20 while the projection 24 retains the marker in position on the green. It is understood that the golf ball, whose position is thus marked, may be removed by any convenient method as by tapping it out of place by the putter head.

When the player whose ball has thus been marked and removed, is to resume his play, he may bring the ball back to its proper position as marked by the marker 20. The handle end of the club is again lowered to the ground and the outer surface of the magnet 18 is contacted with the outer surface of disk 22, whereupon the marker 20 is reattached to the end of the club by the magnetic attraction between magnet 18 and marker 20. When the end of the club is then lifted in a substantially vertical direction, the magnitude of the magnetic attraction is sufficient to lift the projection 24 out of the surface of the green 26 and the marker is thus easily lifted from the green into a position in which the player may readily remove it manually from the club, to be ready for use when again needed.

The provision of the projection 24 is for the purpose of providing sufficient contact with the surface of the green to keep the marker 20 from sliding sideways when the magnet 18 is slid along the marker to disengage it from the magnet. It should be understood that the form of projection 24 illustrated is only an example of a means for providing such resistance to sliding. Therefore any form of the bottom surface of the marker 20 which engages the surface of the green sufficiently to produce the desired effect should be considered to comprise a "a projection" in the sense in which that term will be used in the claims.

Figure 5:
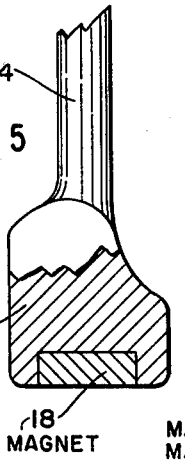
FIG. 5 is an enlarged view, partly in section, of the club head, with a magnet mounted therein, taken approximately along line 5—5 of FIG. 1.
Figure 6:
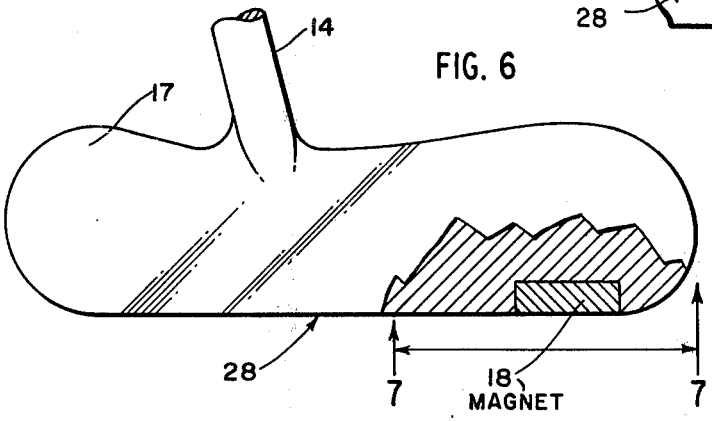
FIG. 6 is a side view, partly in section, of the club head shown in FIG. 5.
Figure 7:
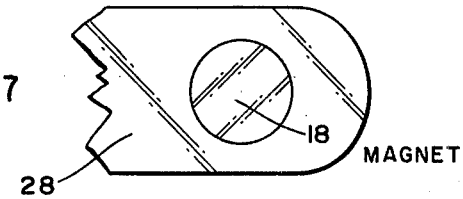
FIG. 7 is a partial bottom view of the club head as indicated by the arrows 7—7 in FIG. 6.

Instead of mounting the magnet 18 in the handle of the club, it may be mounted on any other suitable portion of the club as shown, for example, in FIGS. 5, 6 and 7. In this embodiment, the head, which may be of a non-magnetic material such as brass or bronze, has the magnet 18 embedded into its lower surface. This may be done by drilling a recess into such lower surface and force-fitting the magnet 18 into such recess. Other means of securing magnet 18 may be used, such as by suing an epoxy resin adhesive. Should the head 17 be made of a magnetic material such as steel, the magnet 18 would be surrounded by a non-magnetic sleeve within the recess in the club head 17.

Figure 11:
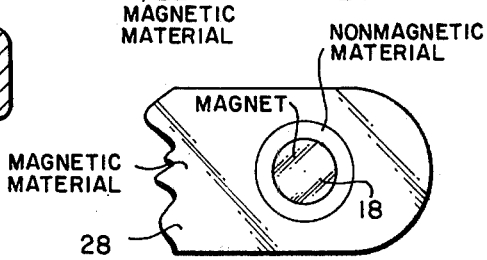
FIG. 11 is a partial bottom view of the club head as indicated by the arrows 7—7 in FIG. 6.
Figure 10:
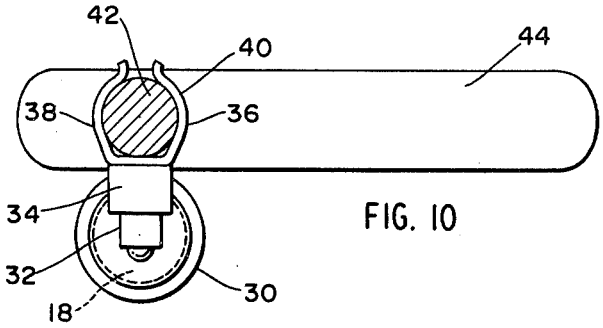
FIG. 10 is a top view of FIG. 9 taken along line 10—10.
Figure 9:
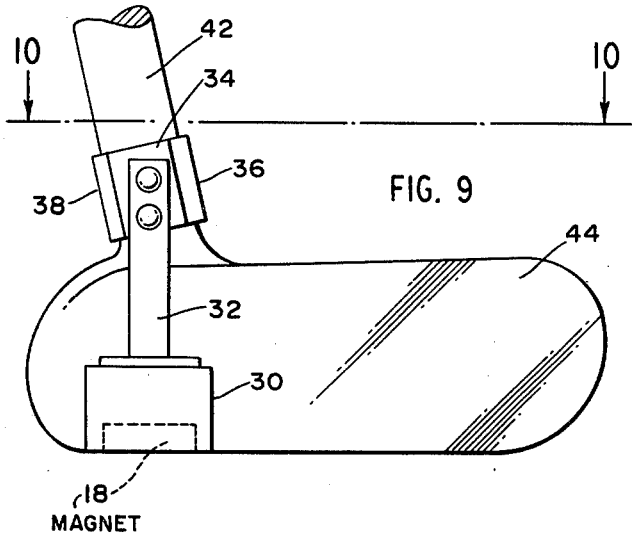
FIG. 9 is a side view of the head of a putter club having a magnet detachably secured thereto.

In the embodiment shown in FIGS. 9 and 10, the magnet 18 is removably attached to a golf club by being mounted in a block 30, of a suitable non-magnetic material. Block 30 is carried by a rod 32 secured at its upper end to a block 34. Block 34 carries a spring arm clip 36, having a pair of spring clip arms 38 and 40 which are adapted to clip around the shaft 42 of a golf club, such as a putter. The length of rod 32 is such that, when clipped to the shaft 42, the bottom of the block 30 is substantially at the same level as the bottom of the club head 44. It will be understood that the outer face of the magnet 18 will be exposed at the lower surface of block 30. The above construction permits the magnet carrying structure to be attached to and detached from any convenient golf club at will. In the embodiment shown in FIG. 11, the club head 17 is composed of a magnetic material, such as steel, and has the magnet 18 embedded into its lower surface. Nonmagnetic sleeve 19 of a suitable nonmagnetic material, such as brass or bronze, surrounds the magnet 18 within the recess in the club head 17.

In the modifications of FIGS. 5 and 9 the use of the magnet 18 to place and remove a marker 20 is exactly the same as described in connection with FIG. 8.

It is to be understood that various other embodiments of the invention described above may be made within the scope of the appended claims. For example, the device for lowering and raising the magnet to and from the surface of the green need not necessarily be a golf club. Thus any elongated rod of a length approximately that of a golf club may be used. Typical golf clubs have lengths within a range of about 37 inches to 41 inches, so that any rod of a length approximately in such a range could be used to carry the magnet desired at an end of such rod. Instead of the magnet comprising a flat disk having a single magnetic pole presented to the marker club, it might take other forms such as one having concentric opposite magnetic poles disposed at its outer surface. Various other modifications will suggest themselves to those skilled in the art.

I claim:

1. A golf club putter useful on combination with a golf ball position marker in placing on or removing from a marked position on the golf green the golf ball position marker, which golf club putter comprises:

a. an elongated rod having a length of about 37 to 41 inches and having a one end and another end;

b. a handle at the one end adapted to be gripped by the user in putting a golf ball on the green;

c. a golf club putter head at the other end composed of a magnetic material and characterized by a bottom surface which is substantially transverse to the other end and a recess in the bottom surface thereof;

d. a permanent magnet in the shape of a flat disc having a magnetic pole disposed transversely to the other end; and e. the permanent magnet secured within a recess in the golf club putter head, the permanent magnet disc surrounded by and separated from the magnetic material by a nonmagnetic sleeve and disposed so that the outer surface of said permanent magnetic disc is substantially flushed with the bottom surface of the golf club putter head.

2. In combination with the golf club of claim 1, a golf ball position marker which comprises a flat disc composed of at least in part a magnetic material having a magnetic pole on the outer surface of said disc, said disc having a projection extending from the other side of said disc opposite said magnetic pole the projection providing means to secure the golf ball position marker to the green, whereby the golf position marker may be secured to the permanent magnet of the golf club putter head solely by means of magnetic attraction between the permanent magnet and the golf club putter head and the magnetic material of the golf ball position marker disc.

3. A method of placing a golf ball position marker in position on a putting green without bending by the user, which method comprises:

a. providing a golf club putter having a golf club putter head at the one end with a bottom surface, the golf club putter head containing a permanent magnet, the outer surface of the magnet being substantially flushed with the bottom surface of the golf club putter head;

b. providing a golf position marker which comprises a material which will adhere to the permanent magnet in the golf club putter head, the marker having a ground engaging projection extending from one surface thereof;

c. manually placing without bending the golf ball position marker into contact with the permanent magnet in the golf club putter head to retain the marker in position solely by magnetic attraction between the marker and the magnet;

d. manually lowering the golf club putter head with the marker to the surface of a putting green and to and above a position on the putting green which is to be marked;

e. pressing the ground engaging projection of the marker into the desired position on the putting green by manually exerting sufficient pressure downwardly on the other end of the golf club putter; and f. sliding the golf club putter head in a lateral direction generally parallel to the surface of the putting green until said magnet has slid sufficiently out of contact with the golf ball position marker, so that the golf club putter head may be removed and the marker left in the desired position on the putting green.

4. The method of claim 3 in which the marker is removed from its position on the putting green, which method comprises:

a. manually lowering without bending the golf club putter head until the magnet is placed in contact with the marker;

b. manually lifting the golf club putter head in a direction generally perpendicular to the surface of the putting green to remove the marker projection from the putting green by the magnitude of the magnetic attraction between the marker and the magnet; and c. manually removing the marker from the golf club putter head for reuse.

5. The method of claim 3 wherein the marker at least in part comprises a ferrous material which adheres to the magnet in the golf club putter head.

6. The method of claim 3 wherein the marker comprises a flat disc of magnetic material with a single ground engaging projection extending outwardly from one surface of the disc.

7. The method of claim 3 wherein the permanent magnet comprises a single magnetic pole on the bottom surface of the golf club putter head.

8. The method of claim 3 wherein the golf club putter head is composed of a nonmagnetic material.

9. The method of claim 3 wherein the golf club putter head is composed of a magnetic material, and wherein the permanent magnet is surrounded by and separated from the magnetic material by a nonmagnetic sleeve.

10. In combination a golf club putter and a golf ball position marker, which combination comprises:

a. a golf club putter comprising
   i. an elongated rod having a one end and another end,
   ii. a handle at the one end adapted to be gripped by the user,
   iii. a golf club putter head at the other end, the putter head characterized by a bottom surface substantially transverse to the other end,
   iv. a permanent magnet having a magnetic pole disposed transversely to the other end of the rod, and
   v. the magnet secured within the golf club putter head, the outer surface of said magnet being substantially flushed with the bottom surface of the golf club putter; and b. a golf ball position marker comprising
   i. a material which will adhere magnetically to the permanent magnet in the golf club putter head, and
   ii. the marker having ground engaging projection means extending from one side of the marker to retain the marker in position on a putting green, whereby the magnet in the golf club putter head is employed in use to place the golf ball position marker onto the putting green and to mark a golf ball position, and to remove the golf ball position marker from the green without the need for the user to bend and stoop for such placement and removal.

11. The combination of claim 10 wherein the permanent magnet comprises a flat disc.

12. The combination of claim 10 wherein the permanent magnet comprises a flat disc with a single magnetic pole on the bottom surface thereof.

13. The combination of claim 10 wherein the golf club putter head is composed of a nonmagnetic material.

14. The combination of claim 10 wherein the golf putter head is composed of a nonmagnetic material of brass or bronze.

15. The combination of claim 10 wherein the golf club putter head is composed of a magnetic material, and wherein the permanent magnet is surrounded and separated from the magnetic material by a nonmagnetic sleeve.

16. The combination of claim 10 wherein the golf club putter head is characterized by a recess in the bottom surface thereof, and the permanent magnet is a magnetic disc forcefitted into said recess.

17. The combination of claim 10 wherein the golf club putter head is characterized by a heel and toe section, and wherein the permanent magnet is disposed in the toe section of the golf club putter head.

18. The combination of claim 10 wherein the marker at least in part comprises a ferrous material which adheres to the magnet in the golf club putter head.

19. The combination of claim 10 wherein the marker comprises a flat disc of magnetic material with a single ground engaging projection extending outwardly from one surface of the disc.

* * * * *